US007588248B2

(12) United States Patent
Hatano

(10) Patent No.: US 7,588,248 B2
(45) Date of Patent: Sep. 15, 2009

(54) SHEET CONVEYING DEVICE AND IMAGE FORMING APPARATUS

(75) Inventor: Fukashi Hatano, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/957,286

(22) Filed: Dec. 14, 2007

(65) Prior Publication Data

US 2008/0143044 A1 Jun. 19, 2008

(30) Foreign Application Priority Data

Dec. 18, 2006 (JP) ..... 2006-339862

(51) Int. Cl.
*B65H 29/00* (2006.01)
*B65H 29/66* (2006.01)
*B65H 15/02* (2006.01)

(52) U.S. Cl. ..... 271/186; 271/65; 414/766

(58) Field of Classification Search ..... 271/186, 271/65; 414/766
See application file for complete search history.

(56) References Cited

U.S. PATENT DOCUMENTS 3,744,614 A * 7/1973 Shooter et al. ..... 198/404
5,941,522 A * 8/1999 Hagstrom et al. ..... 271/225
5,959,278 A * 9/1999 Kobayashi et al. ..... 235/449
6,279,901 B1 * 8/2001 Fulmer ..... 271/272
6,318,914 B1 * 11/2001 Cuo et al. ..... 400/188
6,942,213 B2 * 9/2005 Endo et al. ..... 271/186
7,398,972 B2 * 7/2008 Schuller et al. ..... 271/185

FOREIGN PATENT DOCUMENTS

JP 2001-122479 5/2001

* cited by examiner

*Primary Examiner*—Patrick H MacKey
*Assistant Examiner*—Patrick Cicchino
(74) *Attorney, Agent, or Firm*—Canon USA Inc IP Div

(57) ABSTRACT

A sheet conveying device includes a sheet reversing unit configured to reverse a sheet. The sheet reversing unit includes a pair of rollers configured to be rotatable while being in pressure contact with each other, a connecting mechanism configured to support the pair of rollers such that the pair of rollers are capable of rotating together, a roller driving mechanism configured to transmit a rotational driving force to at least one of the pair of rollers, and a roller-pair rotating mechanism for rotating the pair of rollers supported by the connecting mechanism together. The connecting mechanism supports the pair of rollers such that the pair of rollers is capable of rotating around a nip portion of the pair of rollers that are in pressure contact with each other.

7 Claims, 7 Drawing Sheets

SHEET CONVEYING DEVICE AND IMAGE FORMING APPARATUS

BACKGROUND OF THE INVENTION

1. Field of the Invention

The present invention relates to a sheet conveying device including a sheet reversing mechanism capable of reversing a sheet, and to an image forming apparatus, such as a copy machine, a printer, and a facsimile machine, including the sheet conveying device.

2. Description of the Related Art

In general, a sheet conveying device for an image forming apparatus including a sheet reversing mechanism uses a switch-back method. In the switch-back method, a sheet is pulled into a reversing conveying path and is then extracted in the opposite direction to reverse the sheet. In the sheet conveying device having the sheet reversing mechanism using the switch-back method, the reversing conveying path dedicated to reversing the sheet and a switch for switching conveying paths are required. This leads to an increase in the size of the sheet conveying device and the image forming apparatus.

Accordingly, to reduce the size of the sheet conveying device and the image forming apparatus, a sheet reversing mechanism that reverses a sheet by rotating a pair of planetary rollers while the sheet is nipped therebetween has been suggested. This technique is described in Japanese Patent Laid-Open No. 2001-122479.

The structure of known planetary rollers will be described below with reference to FIGS. 8A to 8C.

A pair of planetary rollers 102 and 103 is used to reverse and convey a small, thick sheet, such as a card. The planetary rollers 102 and 103 are provided on a rotating disc 120 having a diameter corresponding to the length of a side of a card-shaped sheet (hereinafter simply called a sheet) 101 in a conveying direction thereof. The planetary rollers 102 and 103 include a sun roller 102 that functions as a driving roller and that is rotated by a driving force, and a satellite roller 103 that functions as a driven roller and that is capable of holding the sheet 101 between the sun roller 102 and the satellite roller 103. Guides 140 for guiding the sheet 101 toward the planetary rollers 102 and 103 are attached to the rotating disc 120. The rotating disc 120 is supported such that the rotating disc 120 can rotate around a drive shaft of the sun roller 102.

A pair of supply rollers 121 for conveying the sheet 101 to the position between the sun roller 102 and the satellite roller 103 and guides 140 for guiding the sheet 101 are disposed around the rotating disc 120. In addition, a card position sensor 131 for detecting the trailing edge of the sheet 101 supplied by the supply rollers 121 and a rotational angle sensor 132 for detecting the rotational angle of the rotating disc 120 are also disposed around the rotating disc 120.

A sheet-reversing operation performed by the known planetary rollers 102 and 103 having the above-described structure will now be described.

The sun roller 102 is rotated at the same surface speed (peripheral speed) as that of the supply rollers 121. When the sheet 101 is supplied, the rotating disc 120 is stopped at the position shown in FIG. 8A. In this state, the sheet 101 is conveyed by the supply rollers 121 in the direction shown by the arrow X. After the leading edge of the sheet 101 reaches the position where it is nipped between the sun roller 102 and the satellite roller 103, the sheet 101 is further conveyed while being nipped by the planetary rollers 102 and 103. Then, when it is detected by the card position sensor 131 that the trailing edge of the sheet 101 has passed a predetermined position and the overall body of the sheet 101 is supported by the rotating disc 120, the rotating disc 120 starts to rotate together with the sun roller 102 (see FIG. 8B).

When it is detected by the rotational angle sensor 132 that the rotating disc 120 has rotated about 180° and reached the position shown in FIG. 8C, the rotating disc 120 stops rotating. At this time, the sun roller 102 continues to rotate, so that the sheet 101 nipped between the sun roller 102 and the satellite roller 103 is ejected in the direction shown by the arrow Y. The supply rollers 121 are rotated in the direction opposite to that in the state shown in FIG. 8A. Accordingly, the sheet 101 is conveyed by the supply rollers 121 after being reversed by the rotation of the rotating disc 120.

In the above-described known technique, the sheet 101 is rotated around the drive shaft of one of the planetary rollers 102 and 103, i.e., the sun roller 102, while the sheet 101 is nipped between the planetary rollers 102 and 103. Therefore, the sheet 101 cannot be conveyed along a straight conveying path before and after the rotation, but is conveyed along paths that are shifted from each other. In other words, the position at which the sheet 101 is received by the planetary rollers 102 and 103 and the position at which the sheet 101 is ejected therefrom are shifted from each other in the vertical direction in FIGS. 8A to 8C. Therefore, the sheet conveying performance is degraded and the occurrence of jamming is increased.

SUMMARY OF THE INVENTION

The present invention is directed to a sheet conveying device having a small, simple structure and capable of reversing a sheet such that the sheet can be conveyed on a straight line before and after the reversal, and to an image forming apparatus including the sheet conveying device.

According to an aspect of the present invention, a sheet conveying device includes a sheet reversing unit configured to reverse a sheet. The sheet reversing unit includes a pair of rollers configured to be rotatable while being in pressure contact with each other, a connecting mechanism configured to support the pair of rollers such that the pair of rollers are capable of rotating together, a roller driving mechanism configured to transmit a rotational driving force to at least one of the pair of rollers, and a roller-pair rotating mechanism configured to rotate the pair of rollers supported by the connecting mechanism together. The connecting mechanism supports the pair of rollers such that the pair of rollers is capable of rotating around a nip portion of the pair of rollers that are in pressure contact with each other.

Further features of the present invention will become apparent from the following description of exemplary embodiments with reference to the attached drawings.

DESCRIPTION OF THE EMBODIMENTS

An embodiment of the present invention will be described below with reference to the drawings.

A sheet conveying device according to the embodiment of the present invention will be described in detail below. First, the overall schematic structure of an image forming apparatus including the sheet conveying device according to the present embodiment will be described. Then, the structure and operation of a reversing path unit included in the sheet conveying device according to the present embodiment will be described in detail.

Figure 1:
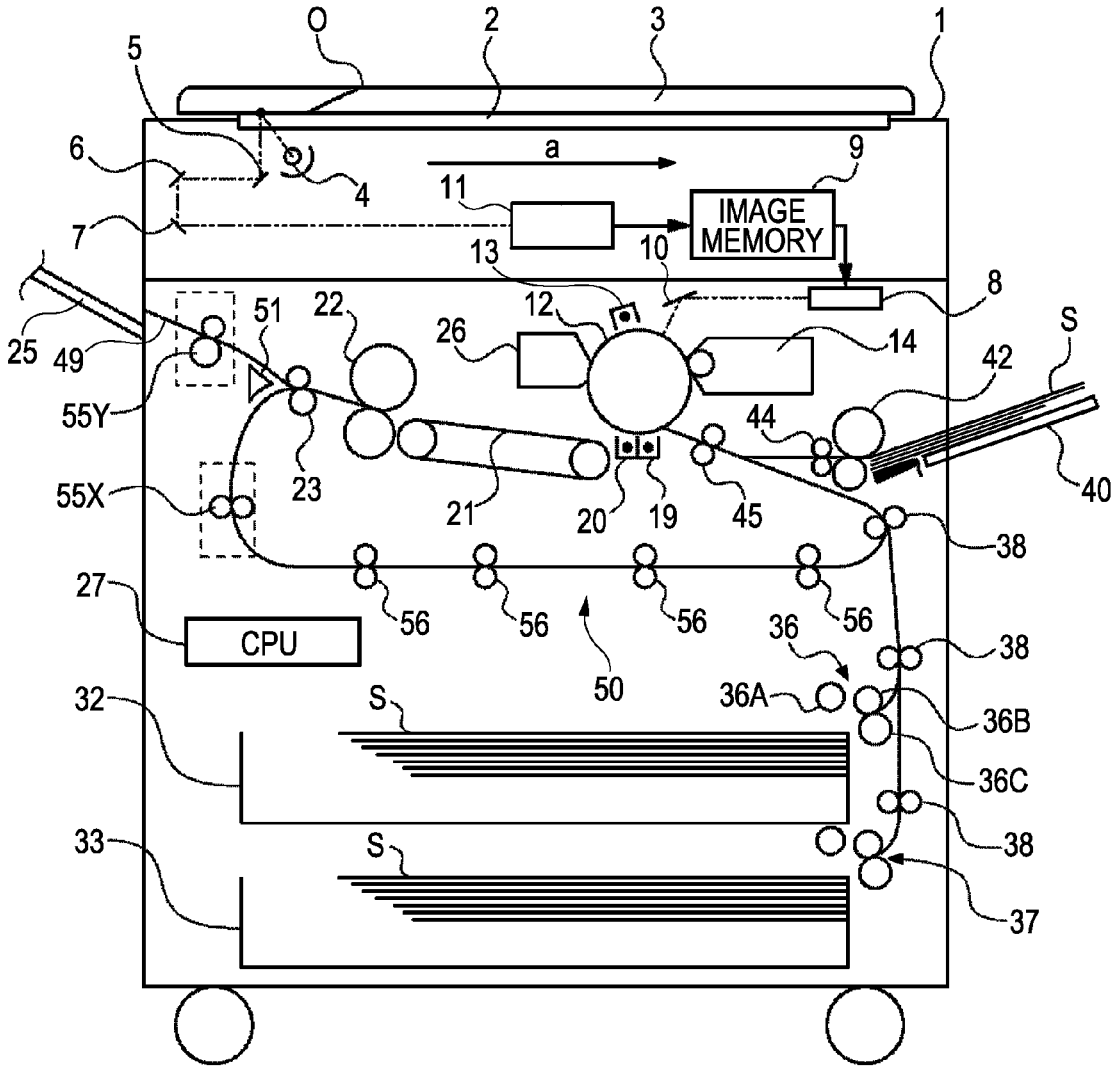
FIG. 1 is a sectional view of an image forming apparatus according to an embodiment of the present invention.

The overall structure of the image forming apparatus will be described with reference to the schematic sectional view shown in FIG. 1. In FIG. 1, the image forming apparatus includes a main body 1. An original plate 2 made of a transparent glass plate and a plate cover 3 are fixed at an upper section of the main body 1. The main body 1 of the image forming apparatus is connected to an automatic document feeder disposed in the upper section thereof. An original O is fed by the automatic document feeder, and is stopped at a predetermined position on the original plate 2 such that an image side thereof faces downward. An optical system placed below the original plate 2 includes a lamp 4 for illuminating the original O, reflective mirrors 5, 6, and 7 for guiding an optical image of the illuminated original O to an image memory 9, and an imaging lens 11. The lamp 4 and the reflective mirrors 5, 6, and 7 move in the direction shown by the arrow a at a predetermined speed, thereby scanning the original O.

An image forming unit includes a photosensitive drum 12, a charger 13, a developing unit 14, a transfer charger 19, a detach charger 20, and a cleaner 26. The charger 13 is provided to uniformly charge the surface of the photosensitive drum 12. A scanner 8 emits, via a mirror 10, an optical image for forming an electrostatic latent image on the surface of the photosensitive drum 12 charged by the charger 13. The developing unit 14 is provided to develop the electrostatic latent image to form a toner image that is to be transferred onto a sheet S. The transfer charger 19 is provided to transfer the toner image on the surface of the photosensitive drum 12 onto the sheet S. The detach charger 20 is provided to remove the sheet S onto which the toner image is transferred from the photosensitive drum 12. The cleaner 26 is provided to remove the toner remaining on the photosensitive drum 12 after the toner image is transferred. As shown in FIG. 1, a central processing unit (CPU) 27 is provided as a control unit for controlling the components included in the apparatus.

A case in which, for example, an image is copied on one side of the sheet S and the sheet S is ejected with the side on which the image is copied facing upward will be described. When a copy start button (not shown) is pressed, a sheet S on a feed tray 32 is fed by a sheet feeding unit 36 including feed rollers 36A, 36B, and 36C, and is conveyed by a plurality of pairs of conveying rollers 38. Then, the tilt of the sheet S is corrected by a pair of registration rollers 45. Alternatively, a sheet S on a feed tray 33 is fed by a sheet feeding unit 37 and is conveyed to the registration rollers 45 by the pairs of conveying rollers 38. A sheet may also be fed from a manual feed tray 40. A sheet S on the manual feed tray 40 is fed by a feed roller 42 and is conveyed to the registration rollers 45 by the pairs of conveying rollers 44.

After the sheet S reaches the registration rollers 45 and the tilt thereof is corrected by the registration rollers 45, the sheet S is conveyed to the image forming unit at a predetermined timing. In the image forming unit, the toner image is transferred onto the sheet S. A belt conveyor unit 21 for conveying the sheet S on which the toner image is transferred and a fixing unit 22 for fixing the image on the sheet S conveyed by the belt conveying unit 21 as a permanent image are disposed on the downstream of the image forming unit. The sheet S having the image fixed thereon by the fixing unit 22 passes through a pair of inner ejection rollers 23, guided by a first switch 51, and is ejected from the main body 1 of the image forming apparatus through an ejection conveying path 49. The ejected sheet S is placed on an ejection tray 25 provided outside the main body 1 of the image forming apparatus.

A reversing roller unit 55, which functions as a sheet reversing unit that characterizes the present invention, will be described with reference to FIGS. 3 and 6. In the present embodiment, the reversing roller unit 55 is used as a pair of duplex reversing rollers 55X and a pair of ejection reversing rollers 55Y.

Figure 2:
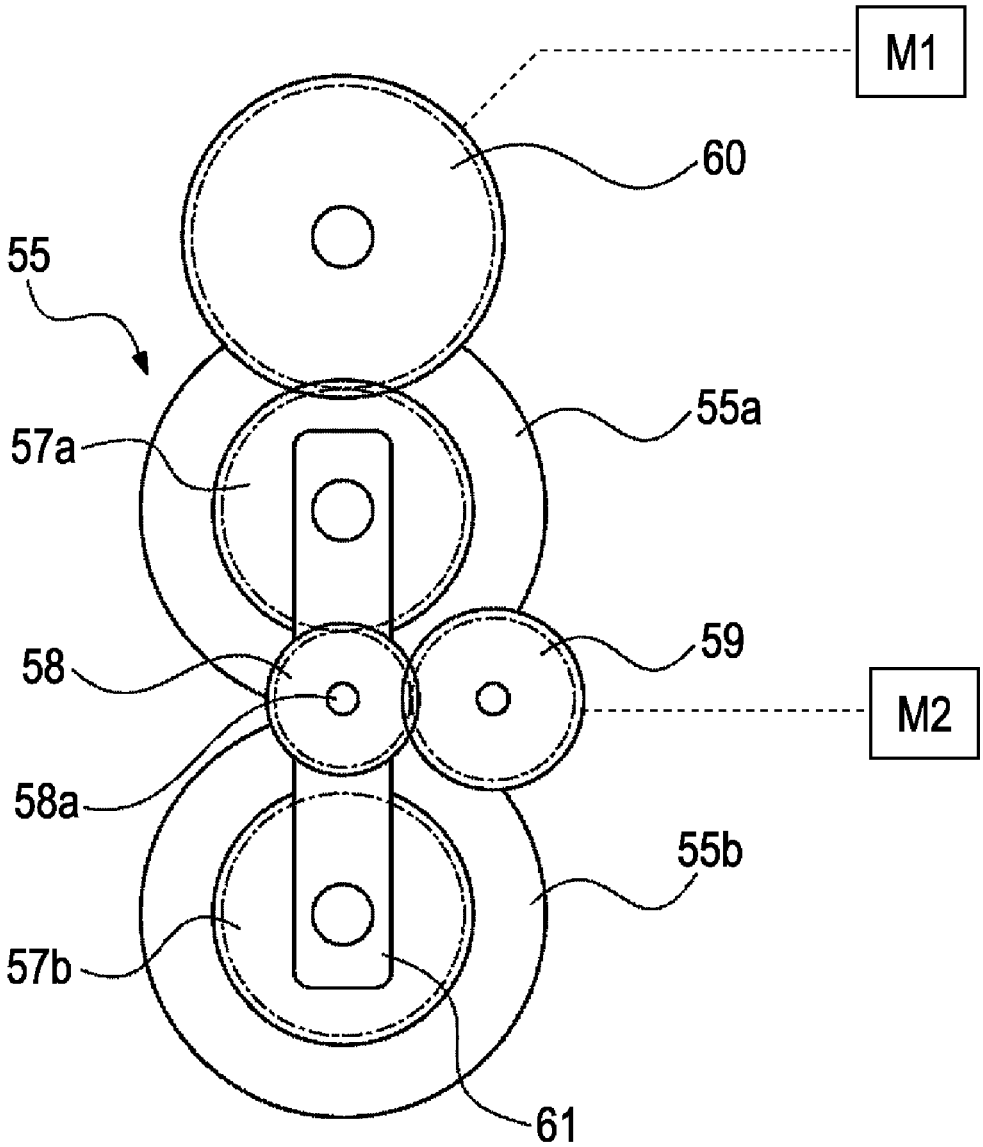
FIG. 2 is a side view of a reversing roller unit according to the embodiment of the present invention.
Figure 3:
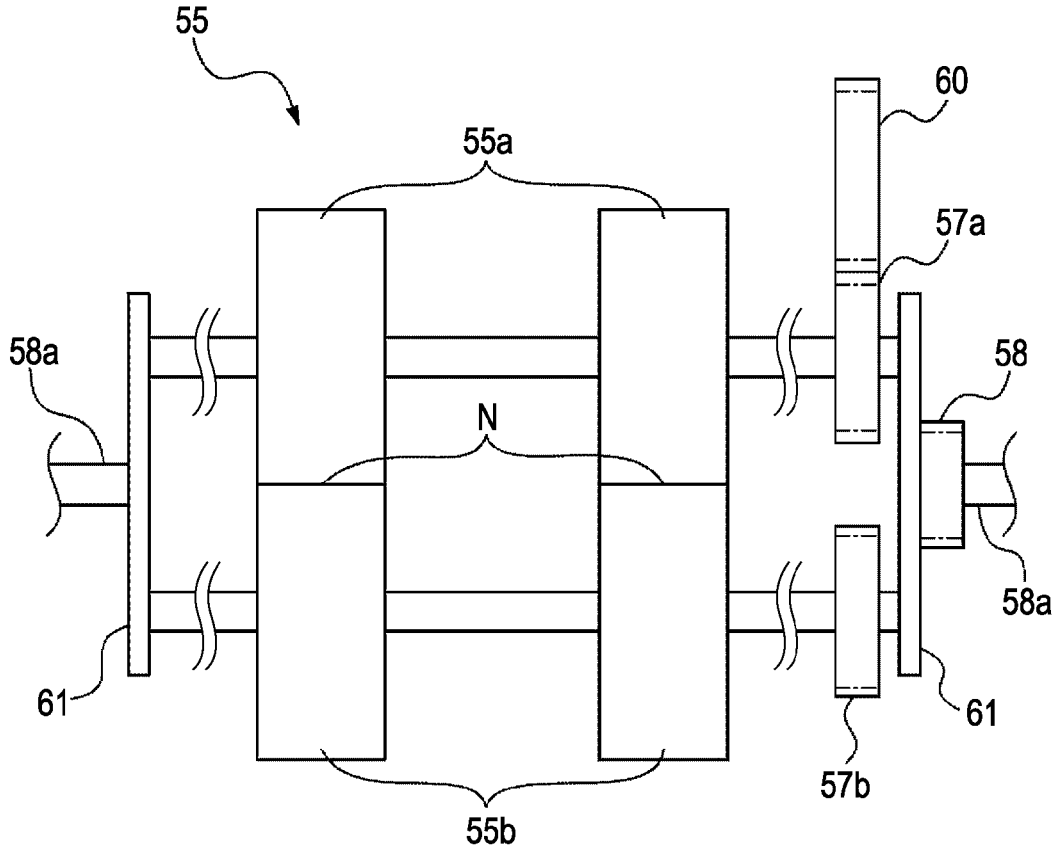
FIG. 3 is a front view of the reversing roller unit according to the embodiment of the present invention.

FIGS. 2 and 3 show an example of the structure of the reversing roller unit 55. FIG. 2 is a side view of the reversing roller unit 55, and FIG. 3 is a front view thereof.

Reversing rollers 55*a* and 55*b* are structured such that rotating shafts of the rollers 55*a* and 55*b* are rotatably supported by connecting units 61, which function as a connecting mechanism, provided on the left and right sides such that the rollers 55*a* and 55*b* are in pressure contact with each other. Thus, the reversing rollers 55*a* and 55*b* are rotatably supported while being in pressure contact with each other.

A roller-pair rotating mechanism for rotating the reversing rollers 55*a* and 55*b* together will now be described. A rotating gear 58 is fixed at the center of one of the connecting units 61, and is rotatably supported by a shaft 58*a*. The other connecting unit 61 is rotatably supported by another shaft 58*a*. In addition, as shown in FIG. 3, the shaft 58*a* of the rotating gear 58 is disposed on a line extending parallel to the axial lines of the roller shafts of the reversing rollers 55*a* and 55*b* from nip portions N provided between the reversing rollers 55*a* and 55*b*. Accordingly, the reversing rollers 55*a* and 55*b* are supported such that the reversing rollers 55*a* and 55*b* can be rotated around the nip portions N in the side view. The number of pairs of the reversing rollers 55*a* and 55*b* is set to one or more depending on maximum and minimum widths of the sheets that can be conveyed. In the present embodiment, two pairs of reversing rollers 55*a* and 55*b* are provided.

The rotating gear 58 meshes with a rotation drive gear 59 to which a rotational driving force is transmitted from a roller-pair rotating motor M2, which is a stepper motor. A driving force is input to the rotating gear 58 from the rotation drive gear 59 through a clutch (not shown) or the like, and thus the overall body of the reversing rollers 55*a* and 55*b* can be rotated.

Next, a roller driving mechanism for rotating each of the reversing rollers 55*a* and 55*b* will be described.

The reversing rollers 55*a* and 55*b* are coaxially integrated with reversing roller gears 57*a* and 57*b*, respectively. The reversing roller gears 57*a* and 57*b* are arranged to be capable of selectively meshing with a reversing-roller drive gear 60 to which a rotational driving force is transmitted from a roller driving motor M1, which is a stepper motor. When the reversing-roller drive gear 60 meshes with the reversing roller gear 57*a*, the reversing rollers 55*a* are rotated by a driving force transmitted thereto, and the reversing rollers 55*b* are rotated by the rotation of the reversing rollers 55*a*.

Similarly, when the reversing-roller drive gear 60 meshes with the reversing roller gear 57*b*, the reversing rollers 55*b* are rotated by the driving force and the reversing rollers 55*a* are rotated by the rotation of the reversing rollers 55*b*. When the overall body of the reversing rollers 55*a* and 55*b* is rotated, the reversing-roller drive gear 60 is separated from both the reversing roller gear 57*a* and the reversing roller gear 57*b*. Therefore, rotation of the reversing rollers 55*a* and 55*b* is stopped.

A trailing-edge detection sensor 52 (see in FIG. 6) that detects the trailing edge of the sheet S being conveyed is disposed on the upstream of the reversing rollers 55*a* and 55*b* in the sheet conveying direction.

Figure 4:
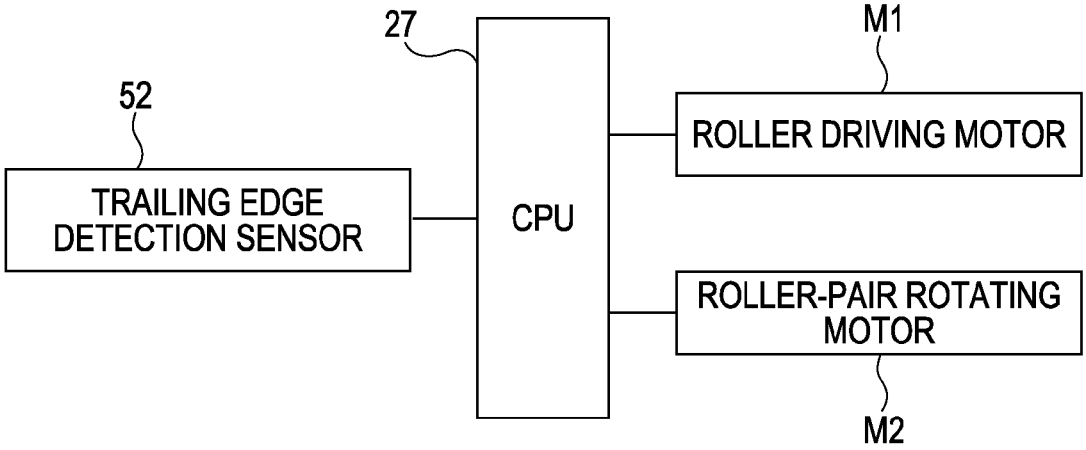
FIG. 4 is a control block diagram according to the embodiment of the present invention.

FIG. 4 is a control block diagram according to the present invention. A detection signal obtained from the trailing-edge detection sensor 52 is input to the CPU 27. The CPU 27 controls the operations of the roller driving motor M1 and the roller-pair rotating motor M2.

Figure 5:
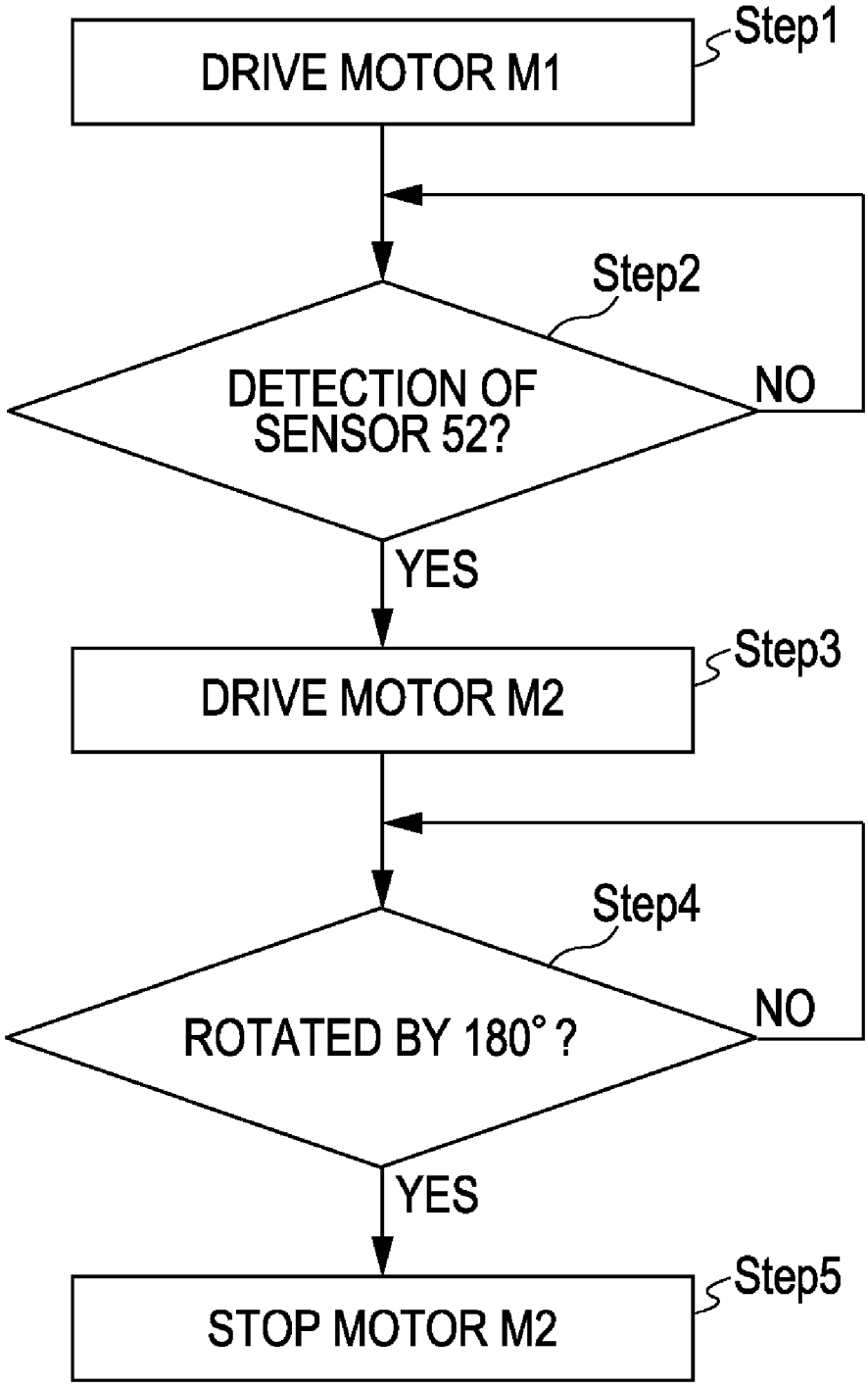
FIG. 5 is a flowchart of an operation according to the embodiment of the present invention.

The operation of the reversing roller unit 55 will be described with reference to FIGS. 5 and 6A to 6E. FIG. 5 is a flowchart of the operation and FIGS. 6A to 6E are diagrams illustrating the operation.

Figure 6A:
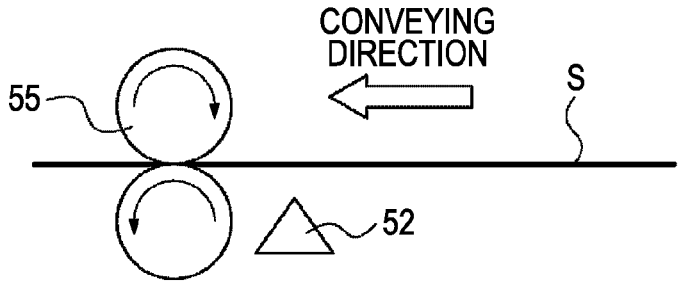
FIGS. 6A to 6E are diagrams illustrating the operation of the reversing roller unit according to the embodiment of the present invention.
Figure 6B:
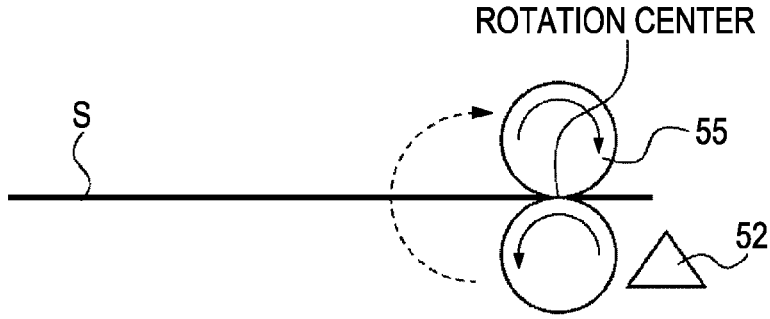

In Step 1, the driving force of the roller driving motor M1 is transmitted from the reversing-roller drive gear 60 to the reversing roller gear 57*a*. Accordingly, as shown in FIG. 6A, the reversing rollers 55*a* and 55*b* are rotated and the sheet S is conveyed leftward in the figure. Then, when the trailing edge of the sheet S is detected by the trailing-edge detection sensor 52 in Step 2, the driving force of the roller-pair rotating motor M2 is transmitted to the rotating gear 58 through the rotation drive gear 59, so that the connecting units 61 are rotated in Step 3. Accordingly, as shown in FIG. 6B, the reversing rollers 55*a* and 55*b* rotate (revolve) around the nip portions N thereof. In FIG. 6B, the overall body of the reversing rollers 55*a* and 55*b* is rotated clockwise.

Figure 6C:
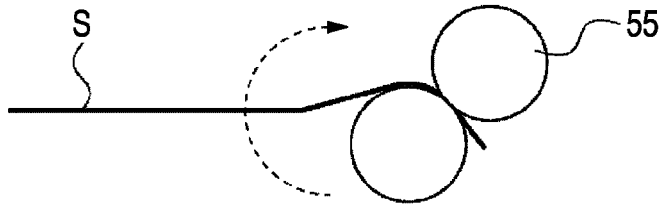
Figure 6D:
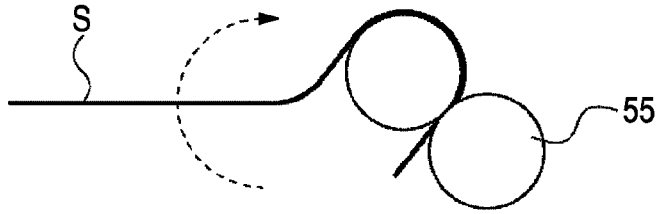

While the reversing rollers 55*a* and 55*b* are rotating (revolving) as shown in FIGS. 6C and 6D, the reversing-roller drive gear 60 meshes with neither of the reversing roller gears 57*a* and 57*b*. The reversing rollers 55*a* and 55*b* start to rotate (revolve) before the trailing edge of the sheet S passes through the nip portions N between the reversing rollers 55*a* and 55*b*. Therefore, the driving force is applied to neither of the reversing rollers 55*a* and 55*b*, and the reversing rollers 55*a* and 55*b* are rotated while the sheet S is nipped therebetween.

Figure 6E:
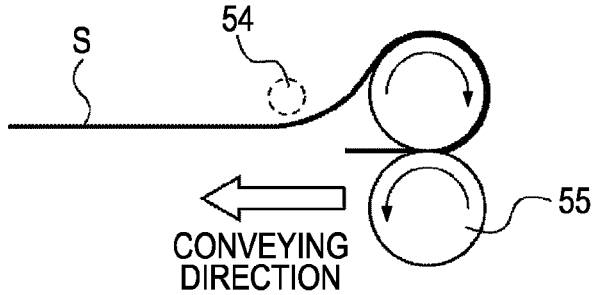

If it is determined that the overall body of the reversing rollers 55*a* and 55*b* is rotated by 180° as shown in FIG. 6E in Step 4, the driving force applied to the rotating gear 58 from the rotation drive gear 59 is canceled to stop the reversing rollers 55*a* and 55*b* in Step 5. The rotation of the reversing rollers 55*a* and 55*b* may be stopped at 180° using a sensor (not shown) or be automatically stopped at 180° by setting a step number of the stepper motor.

In this state, the reversing-roller drive gear 60 meshes with the reversing roller gear 57*b* so that the driving force is transmitted. Accordingly, each of the reversing rollers 55*a* and 55*b* is rotated around the center thereof and the sheet S is conveyed in the same direction as the direction shown in FIG. 6A. Thus, the sheet is conveyed along the same plane before and after the reversal.

A sheet guide 54 is disposed on the downstream of the reversing rollers 55*a* and 55*b* in the sheet conveying direction. The sheet guide 54 serves to prevent flopping of the sheet S in the reversing process, thereby increasing the conveying stability. The sheet guide 54 may be a roller, a spur roller, or a plate on which a sheet having a high sliding performance is attached.

In addition, the rotating direction of the rotation drive gear 59 can be selectively switched so that the rotating (revolving) direction of the reversing rollers 55*a* and 55*b* can be switched between positive and negative directions depending on the direction in which the sheet S is curled. For example, in FIG. 3, if the sheet S is curled upward (i.e., if the vertical position of the sheet at the leading end is higher than that at an intermediate position) when the sheet S reaches the reversing rollers 55*a* and 55*b*, the reversing rollers 55*a* and 55*b* are rotated counterclockwise. Accordingly, curling of the sheet S can be corrected by winding the sheet S around the reversing rollers 55*b* in a direction opposite to the direction in which the sheet S is curled.

Figure 7A:
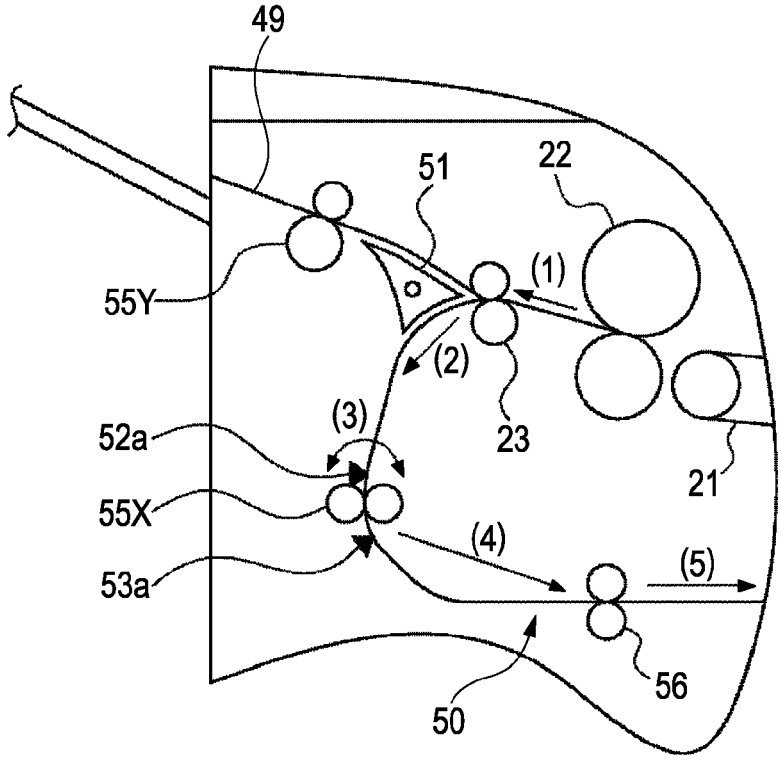
FIGS. 7A and 7B are diagrams illustrating the structure of a part of an image forming apparatus including the reversing roller unit according to the embodiment of the present invention.
Figure 7B:
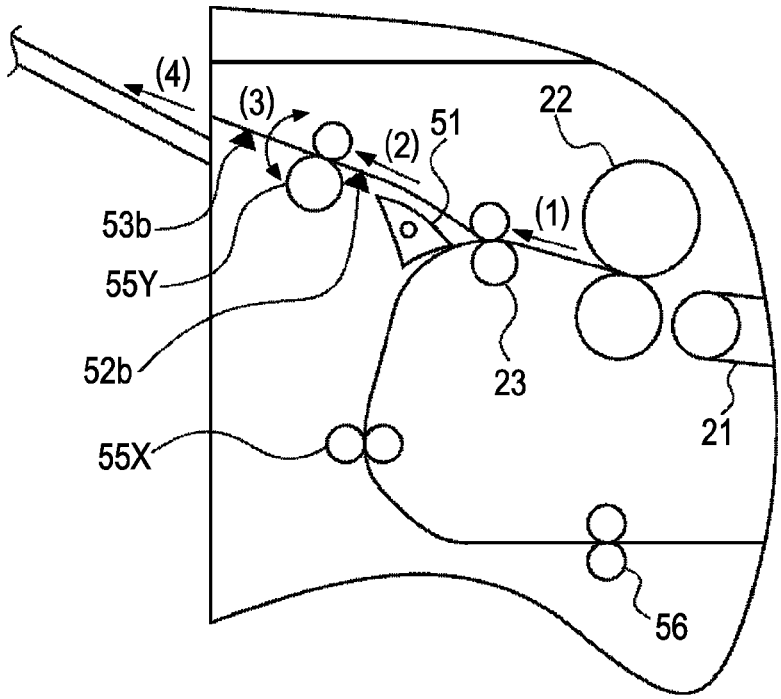
Figure 8A:
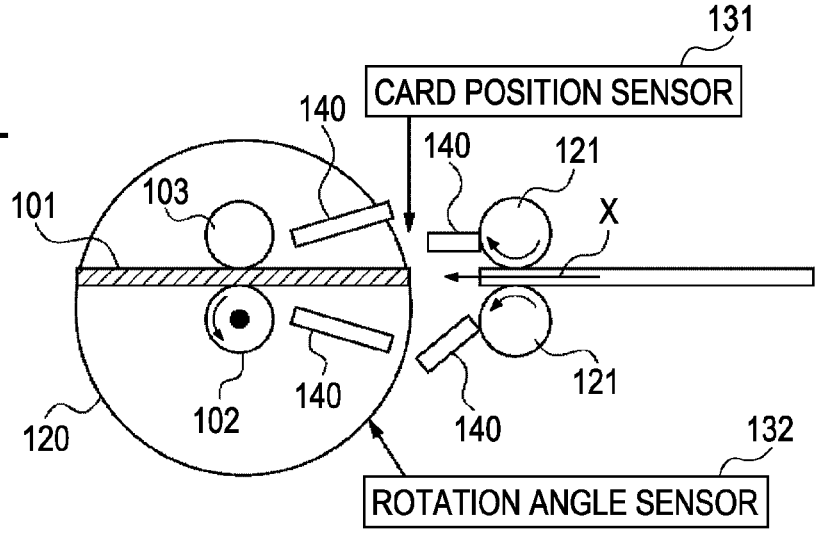
FIG. 8A PRIOR ART
FIGS. 8A to 8C are diagrams illustrating an example of a known reversing roller unit.
Figure 8B:
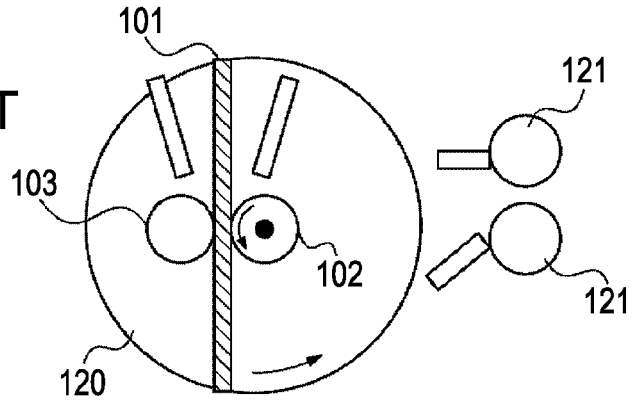
FIG. 8B PRIOR ART
Figure 8C:
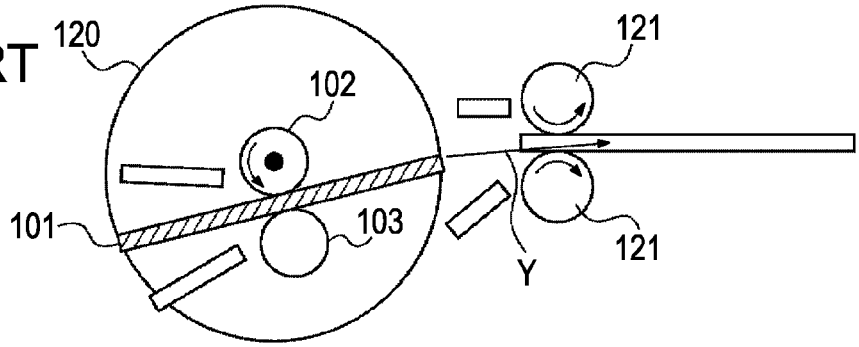
FIG. 8C PRIOR ART

An example in which the reversing roller unit 55 is used in an image forming apparatus will be described. Referring to FIGS. 7A and 7B, the structure of the reversing roller unit 55 is applied to the duplex reversing rollers 55X and the ejection reversing rollers 55Y. The duplex reversing rollers 55X are provided at an intermediate position (position near the fixing unit 22) of a duplex conveying path 50 for conveying the sheet S having an image formed on one side thereof to the image-forming unit again to form images on both sides. Trailing-edge detection sensors 52*a* and 53*a* are respectively placed in front of and behind the nip portion of the duplex reversing rollers 55X in the sheet-conveying direction.

The ejection reversing rollers 55Y are provided at an intermediate position (position near the fixing unit 22) of an ejection conveying path 49 for ejecting the sheet S having an image formed on one side thereof in such a manner that the image faces downward. Trailing-edge detection sensors 52*b* and 53*b* are placed in front of and behind the nip portion of the ejection reversing rollers 55Y in the sheet-conveying direction.

An operation of forming images on both sides of the sheet by the image forming unit (duplex copying) will be described below with reference to FIG. 7A. The numbers with parentheses show the order in which the sheet is conveyed. Processes from feeding of the sheet S to fixing is similar to those in the above-described single-sided image forming operation, and explanations thereof are thus omitted.

The first switch 51 is rotated by a drive unit (not shown) to a position shown in FIG. 7A in advance. Therefore, the sheet S having an image formed on one side thereof is conveyed toward the duplex reversing rollers 55X ((1)→(2)). Then, when the trailing edge of the sheet S is detected by the trailing-edge detection sensor 52*a* disposed on the upstream of the duplex reversing rollers 55X, the duplex reversing rollers 55X are rotated by 180° ((3)). While the duplex reversing rollers 55X are being rotated, the driving force is not applied to the reversing rollers 55*a* and 55*b*, so that the duplex reversing rollers 55X can be rotated while the sheet S is nipped therebetween. After the sheet S is rotated by 180° and reversed by the duplex reversing rollers 55X, the sheet S is conveyed toward a plurality of pairs of rollers 56 provided on the duplex conveying path 50 ((4)).

Then, when the trailing edge of the sheet S is detected by the trailing-edge detection sensor 53*a* disposed on the downstream of the duplex reversing rollers 55X, the operation of the motors and the like is stopped so that the next sheet S can be received. The sheet S ejected from the duplex reversing rollers 55X is conveyed toward the image forming unit again by the plurality of pairs of rollers 56 ((5)). The following processes are similar to those in the single-sided image forming operation, and explanations thereof are thus omitted.

Next, an operation of ejecting the sheet S having an image formed on one side thereof such that the image faces downward (reversed ejection) will be described with reference to FIG. 7B. Processes from feeding of the sheet S to fixing is similar to those in the above-described single-sided image forming operation, and explanations thereof are thus omitted.

The first switch 51 is rotated by a drive unit (not shown) to a position shown in FIG. 7B in advance. Therefore, the sheet S having an image formed on one side thereof is conveyed toward the ejection reversing rollers 55Y ((1)→(2)). Then, when the trailing edge of the sheet S is detected by the trailing-edge detection sensor 52*b* disposed on the upstream of the ejection reversing rollers 55Y, the ejection reversing rollers 55Y are rotated by 180° ((3)). While the ejection reversing rollers 55Y are being rotated, the driving force is not applied to the ejection reversing rollers 55Y, so that the ejection reversing rollers 55Y can be rotated while the sheet S is nipped therebetween ((4)).

After the sheet S is rotated by 180° and reversed by the ejection reversing rollers 55Y, the sheet S is ejected to the ejection tray 25 such that the side on which the image is formed faces downward. Then, when the trailing edge of the sheet S is detected by the trailing-edge detection sensor 53*b* disposed on the downstream of the ejection reversing rollers 55Y, the operation of the motors and the like is stopped so that the next sheet S can be received.

Thus, by using the reversing roller unit according to the present invention, the sheet conveyed to the reversing roller unit can be reversed and ejected along a path that is aligned with (on the same straight line as) the path along which the sheet has been conveyed to the reversing roller unit. Therefore, compared to the known structure, the sheet conveying performance can be increased and the occurrence of jamming can be reduced. In addition, the size of the sheet conveying device and the image forming apparatus can be reduced.

Although gear drive units using stepper motors as drive sources have been described in the present embodiment, the present invention is not limited to this. For example, the reversing roller unit 55 may also be driven using DC motors, belts, etc.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-339862 filed Dec. 18, 2006, which is hereby incorporated by reference herein in its entirety.

What is claimed is:

1. A sheet conveying device comprising:

a sheet reversing unit configured to reverse a sheet, wherein the sheet reversing unit includes:

a pair of rollers configured to be rotatable while being in pressure contact with each other;

a connecting mechanism configured to support the pair of rollers such that the pair of rollers are capable of rotating together;

a roller driving mechanism configured to transmit a rotational driving force to at least one of the pair of rollers;

a roller-pair rotating mechanism configured to rotate the pair of rollers supported by the connecting mechanism together, and wherein the connecting mechanism supports the pair of rollers such that the pair of rollers is capable of rotating around a nip portion of the pair of rollers that are in pressure contact with each other, and wherein the roller driving mechanism includes:

roller gears coaxially arranged on respective shafts of the pair of rollers; and a roller drive gear that meshes with one of the roller gears when the pair of rollers is stationary and meshes with neither of the roller gears when the pair of rollers is rotated by the roller-pair rotating mechanism, and wherein a driving force for rotating the pair of rollers is transmitted when the roller drive gear meshes with one of the roller gears.

2. The sheet conveying device according to claim 1, wherein the roller-pair rotating mechanism includes a shaft disposed on a line extending along the axial directions of the rollers from the nip portion of the rollers that are in pressure contact with each other, and wherein the connecting mechanism is rotatably supported by the shaft and is rotated so as to rotate the pair of rollers together around the shaft.

3. The sheet conveying device according to claim 2, wherein the rotating direction of the roller-pair rotating mechanism is switchable, and is selectively switched depending on a direction of curling of the sheet conveyed to the pair of rollers.

4. The sheet conveying device according to claim 1, further comprising a sheet detecting unit configured to detect whether the sheet is disposed on an upstream of the pair of rollers, and wherein the sheet is conveyed by rotating the pair of rollers with the driving force transmitted from the roller driving mechanism, is reversed by stopping the rotation of the pair of rollers before the trailing edge of the sheet passes therethrough on the basis of a result of detection performed by the sheet detecting unit and causing the roller-pair rotating mechanism to rotate the pair of rollers together by 180°, and is ejected by rotating the pair of rollers with the driving force transmitted from the roller driving mechanism.

5. The sheet conveying device according to claim 1, further comprising a sheet guide disposed at a downstream of the pair of rollers, the sheet guide regulating the movement of the sheet when the pair of rollers is rotated together while the sheet is nipped therebetween.

6. An image forming apparatus comprising:

an image forming unit configured to form an image on a sheet; and a sheet reversing unit configured to reverse the sheet on which the image is formed by the image forming unit, the sheet reversing unit including:

a pair of rollers configured to be rotatable while being in pressure contact with each other;

a connecting mechanism configured to support the pair of rollers such that the pair of rollers are capable of rotating together;

a driving mechanism configured to transmit a rotational driving force to at least one of the pair of rollers;

a roller-pair rotating mechanism configured to rotate the pair of rollers supported by the connecting mechanism, wherein the connecting mechanism supports the pair of rollers such that the pair of rollers is capable of rotating around a nip portion of the pair of rollers that are in pressure contact with each other, and wherein the roller driving mechanism includes:

roller gears coaxially arranged on respective shafts of the pair of rollers; and roller drive gear that meshes with one of the roller gears when the pair of rollers is stationary and meshes with neither of the roller gears when the pair of rollers is rotated by the roller-pair rotating mechanism, and wherein a driving force for rotating the pair of rollers is transmitted when the roller drive gear meshes with one of the roller gears.

7. The image forming apparatus according to claim 6, further comprising:

an ejection conveying path to which the sheet on which the image is formed by the image forming unit is ejected; and a duplex conveying path facilitating conveying again the sheet on which the image is formed to the image forming unit, wherein the sheet reversing unit is provided at each of the ejection conveying path and the duplex conveying path.

* * * * *